United States Patent [19]

Flock et al.

[11] Patent Number: 4,944,210

[45] Date of Patent: Jul. 31, 1990

[54] MISSILE LAUNCHER

[75] Inventors: Thomas G. Flock, Thousand Oaks; Scott D. Baysinger, Chatsworth, both of Calif.

[73] Assignee: Hughes Aircraft Company, Los Angeles, Calif.

[21] Appl. No.: 229,882

[22] Filed: Aug. 8, 1988

[51] Int. Cl.[5] ..... F41F 3/04

[52] U.S. Cl. ..... 89/1.818; 89/1.816; 102/531

[58] Field of Search ..... 89/1.818, 1.816, 1.704, 89/1.705, 1.706, 1.703, 1.7, 1.14; 102/530, 531

[56] References Cited

U.S. PATENT DOCUMENTS

| | | | |
|---|---|---|---|
| 3,035,494 | 5/1962 | Musser | 89/1.704 |
| 3,800,656 | 4/1974 | Schnäbele | 89/1.701 |
| 3,815,469 | 6/1974 | Schubert et al. | 89/1.701 |
| 3,944,251 | 3/1976 | Lynch | 102/531 |
| 4,047,465 | 9/1977 | Wohford | 89/1.14 |
| 4,068,862 | 1/1978 | Ishi et al. | 102/531 |
| 4,151,798 | 5/1979 | Ridgeway | 89/1.818 |
| 4,203,347 | 5/1980 | Pinson et al. | 89/1.816 |
| 4,249,673 | 2/1981 | Katoh et al. | 102/530 |
| 4,392,412 | 7/1983 | Schmidt et al. | 89/1.816 |
| 4,426,909 | 1/1984 | Carter | 89/1.816 |

*Primary Examiner*—David H. Brown

*Attorney, Agent, or Firm*—Michael W. Sales; Wanda K. Denson-Low

[57] ABSTRACT

An elongate gas-tight elastic bag has one open end unitarily secured to an inflator/thruster which can be actuated to rapidly fill the bag with gas. The bag and inflator/thruster are located within a missile launch tube and the bag expands upon being filled with gas to launch the missile.

11 Claims, 2 Drawing Sheets

MISSILE LAUNCHER

BACKGROUND OF THE INVENTION

1. Field of the invention

The present invention relates generally to a tube launched missile, and, more particularly, to a launcher for such a missile which substantially reduces both the launch visual signature and the acoustic signature while providing the capability of delivering a higher launch velocity than conventionally obtained.

2. Description of Related Art

The conventional technique for launching a missile from a tube is to utilize a rocket motor which is an integral part of the missile. Such rocket motors must be contained within a limited envelope because of the need for space by other sub-systems, such as controls, a beacon, wire bobbins, and the like, which usually must occupy the same base region of the missile. To minimize the motor envelope, it has been found necessary to rely upon the use of high energy, fast burning propellants, and high operating pressures.

Other apparatus have been suggested for launching missiles from a launching tube or platform without the use of rocket fuel. For example, U.S. Pat. No. 4,333,382 describes a hydraulic actuating system utilizing a high pressure piston stroke over a short distance for accelerating a missile up to launch speed immediately prior to initiation of the missile motor. Briefly, the patented apparatus includes a pneumatic/ hydraulic system to systematically and sequentially remove restraining supports holding the missile to the launcher, and a telescopic piston assembly for driving the missile to a predetermined initial velocity.

There are other methods and techniques which can be generally referred to as "pneumatic", in which compressed fluids such as air are used to propel the missile into flight. For example, such techniques are disclosed in U.S. Pat. Nos. 3,605,549; 3,968,945; and 4,040,334. However, these techniques are all accompanied by one or more disadvantages including the requirement of external fasteners on the missiles which reduces aerodynamic performance, high cost of maintenance, and the necessity for cleaning the apparatus and launch tube after a small number of firings thereby limiting the number of missions an aircraft, for example, can make before maintenance must be performed.

SUMMARY OF THE INVENTION

The launcher to be described achieves its most advantageous utilization in providing initial powering of a missile from an open-ended launch tube. This launcher includes an elongate elastic bag which is substantially gas tight in construction having dimensions substantially identical to the interior dimensions of the missile launching tube. One end of the launch bag is closed and adapted to contact the aft end of the missile when located in the launch tube. The opposite end of the bag is open and sealingly secured to an integrated inflator/-thruster which, as will be described, produces gas for rapidly filling and expanding the bag that acts on the missile aft end to eject the missile from the launch tube.

The inflator/thruster includes a housing having a quantity of a solid propellant which on ignition produces gases which flow through a foraminous diffuser into the launch bag to inflate it. Simultaneously, gases exhaust rearwardly through low pressure ports producing thrust which balances the launch force eliminating recoil.

In an alternative embodiment, the launch bag closed end is provided with a configured outer surface complementary to that of the missile base in order to accommodate specially shaped structures on the base.

DESCRIPTION OF THE PREFERRED EMBODIMENTS

Figure 1:
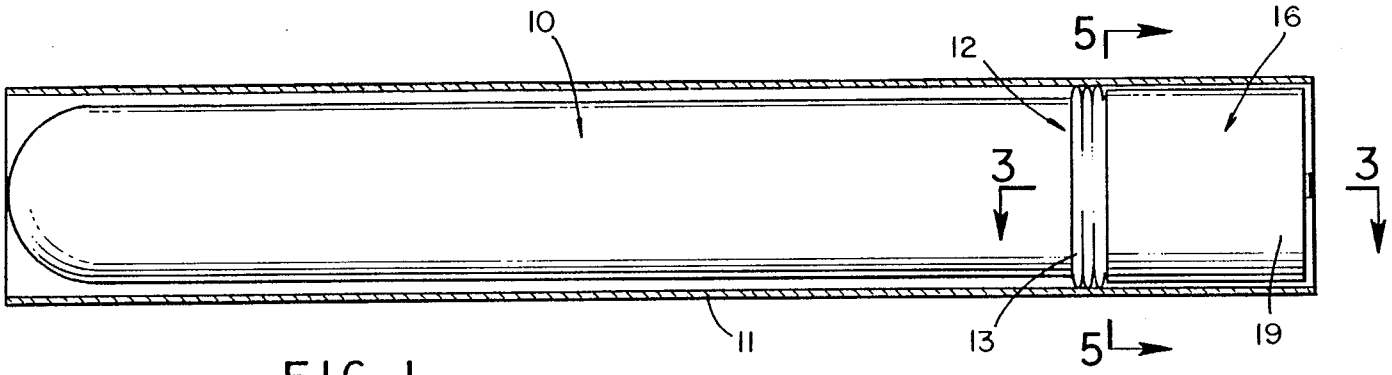
FIG. 1 is a side elevational, partially sectional view of a launch tube showing the invention prior to operation.
Figure 2:
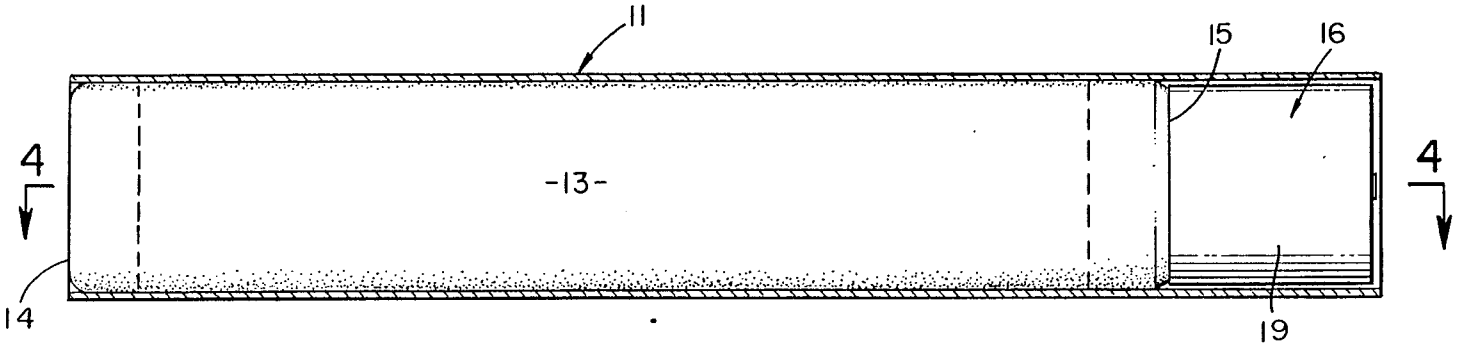
FIG. 2 is a side elevational, partially sectional view similar to FIG. 1 except the launch bag of the present invention is shown in expanded condition.
Figure 5:
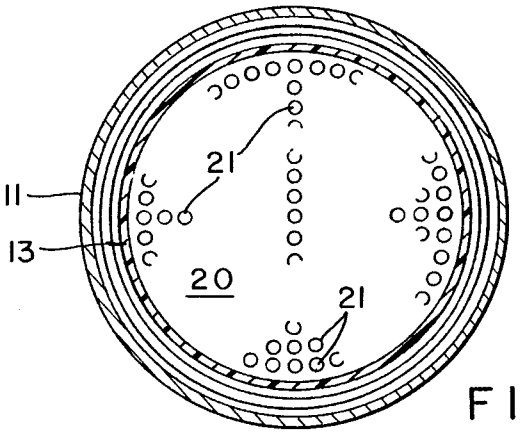
FIG. 5 is an end elevational, sectional view taken along line 5—5 of FIG. 1 looking directly into the diffuser.

Turning now to the drawings and particularly FIGS. 1 and 2, a missile 10 to be launched from an open-ended tube 11 conventionally has its own launch motor (not shown) which may be a unitary part of the missile. Not only does this arrangement raise questions of efficiency and reduction in payload for the missile, but such launchings are accompanied by relatively high visual and acoustic signatures which desirably should be eliminated or reduced.

In its broadest contemplation, the launcher 12 of this invention includes a bag 13 having a closed end 14 and an opposite open end 15, the closed end being located adjacent to the base of the missile when positioned within the launch tube 11. The open end 15 of the bag is sealed to a gas generating inflator/thruster 16, which, upon ignition, provides a supply of pressurized gas to the interior of the bag causing it to rapidly expand and eject the missile. As will be more particularly shown and described, the invention launches a missile with a substantial reduction in the visual and acoustic signature which reduces the possibility of detection and the taking of countermeasure against the missile.

The collapsible bag 13 is an elastic membrane preferably constructed of a closely woven fabric such as nylon forming a substantially non-porous sidewall. The expanded bag is a cylindrical envelope having a closed end 14 which can preferably be reinforced if required. The closed end is contemplated for contact with the missile aft end in use, so reinforcement may be needed to prevent damage to or leakage of the bag. Such reinforcement may take several different forms, a preferred one of which is to use multiple layers of the nylon fabric or other bag material.

The opposite end 15 of the launch bag is open and is of such a dimension relative to the thruster that it can be received thereon and preferably sealed to the thruster by a quantity of epoxy 17, for example, that extends completely about the thruster. Alternatively, a clamp ring (not shown) may be used to effect sealing relation between the bag and the thruster.

The lower end portion 18 of the bag open end is preferably treated with a material which has good heat insulation properties to protect the bag material from excessive heat transfer during inflation. Suitable materials for this purpose include any polymeric material, such as EPDM, for example. When fully in place upon the thruster, the interior of the bag forms a substantially gas tight plenum which is inflated by gases upon burning a solid propellant. As seen best in FIG. 2, when the bag 13 is fully inflated it and the thruster 16 substantially fill the missile launch tube.

Figure 3:
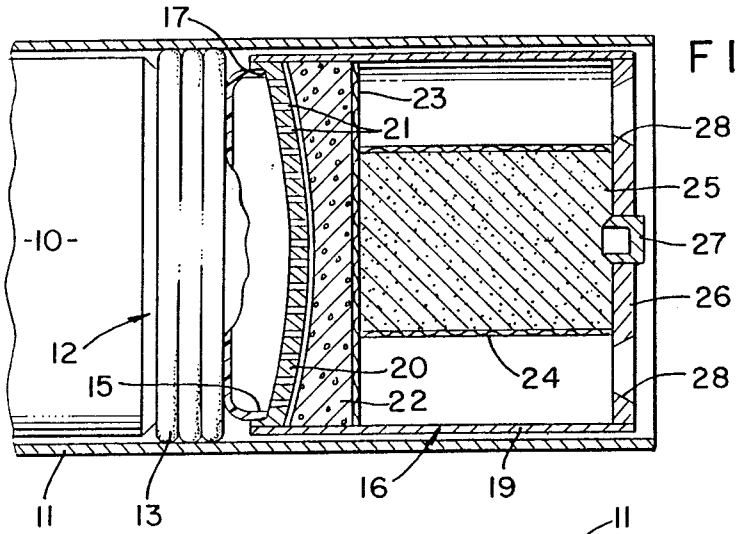
FIG. 3 is an enlarged, side elevational, sectional view taken through the inflator/thruster of the present invention along the line 3—3 of FIG. 1.
Figure 4:
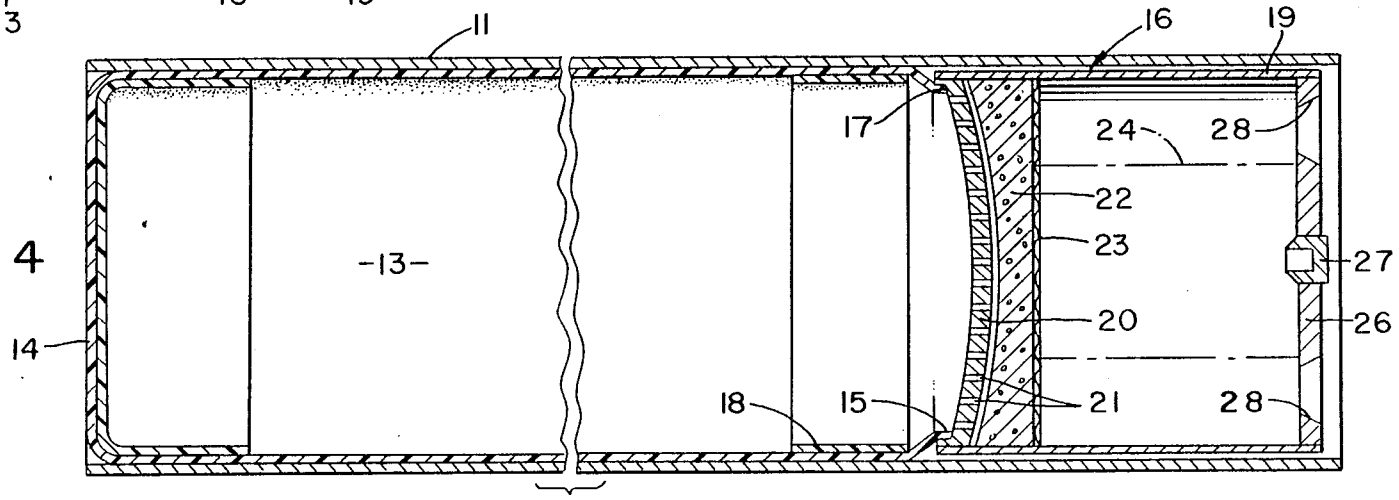
FIG. 4 is a side elevational, sectional view taken along the line 4—4 of FIG. 2.

For the ensuing description of the inflator/ thruster details, reference is now made to FIG. 3, in which the inflator/thruster is seen to include a shell casing 19 which has an outer diameter such that it can be slidingly received within the launch tube 11. A diffuser 20 consisting of an arcuately shaped metal plate has a diameter such that it can be fit within the inner end of the thruster shell casing 19 and includes a plurality of openings 21 for transmission of propellant gas, as will be described. The diffuser plate is affixed to the inner wall of the housing by any suitable means such as welding or bonding, for example.

Although it is not believed that extra cooling of the gases would be necessary in most cases, depending upon a variety of factors there may be circumstances in which a gas cooling section may be advisable. Accordingly, in the latter case immediately adjacent the diffuser plate a quantity of granulated coolant material 22 such as silicon dioxide ($SiO_2$) may be provided, for example, which would act to remove heat from the propellant gas as it moves therethrough, and, in that way, reduce heat applied to the bag during launch. Such a gas coolant bed would be secured in place against the diffuser plate by a wire mesh containment screen 23 and secured to the casing inner wall surface by welding, or other suitable means.

A cylindrical wire mesh container 24 has one end secured to the center of screen 23 and extends coaxially rearward. A quantity 25 of a suitable solid propellant is located within the container. A low signature solid propellant, such as sodium azide, for example, which has a relatively low temperature on burning and is nontoxic, is excellent for this purpose, The propellant container is enclosed at its rear by a plate 26 including a centrally located igniter 27. The propellant containment plate has a plurality of openings 28 which serve as nozzles in generating thrust to equilibrate eject recoil.

In use, the thruster 16 with collapsed launch bag 13 is located in the lower end of the launch tube 11 and the missile is placed within the tube resting its lower end upon the bag end portion 14 as shown in FIG. 1. The igniter 27 is then energized and the solid propellant on ignition produces pressurized gas which passes through the coolant material 22 (if used) and then through the diffuser 20 rapidly expanding the launch bag to its fully inflated condition as shown in FIG. 2.

This expansion of the bag launches the missile from the tube. At the same time that the bag is being inflated, a precise predetermined amount of propellant gases exit via the thruster nozzle openings or ports 28 in the direction opposite to missile launching which provides a necessary reaction to the launch recoil. A net recoil force of substantially zero is obtained so that there is no tendency for the inflator/thruster and interconnected launch bag to move rearwardly or out of the launch tube.

By use of the described invention, there is a substantial reduction in the acoustic signature as well as visual signature which reduces the possibility of detection of the missile launching and countermeasures being taken. In view of the fact that the described launch system remains with the launch tube, missile payload capability is enhanced, or alternatively, missile flight weight is reduced since the expended launch motor is not carried to the target. Since the launch motor has been removed from the missile, there is additional volume for controls, beacon, wire bobbins, or other missile components.

Although the invention has been described in a preferred form, it is to be understood that one skilled in the appertaining art could utilize a modified form and different components therein without departing from the spirit of the invention. For example; the solid propellant gas source could be replaced by a suitable slow burning liquid propellant carried within a suitable container. Also, although nylon fabric is preferred for constructing the bag 13, a number of flexible or elastic plastic materials or closely woven fabrics would be satisfactory for this purpose.

What is claimed is:

1. Apparatus for launching a missile, comprising:

an open-ended tube for receiving the missile therewithin, said tube being longer than the missile and having fore and aft ends;

a selectively actuatable pressurized gas generator having external dimensions enabling sliding receipt of the generator within the tube aft end, said generator having a diffusor through which gas can move along in a first direction and a plurality of openings through which gas can move in a second direction generally opposite to the first direction; and an expandable, air-tight, bag-like member, said bag-like member having an opening for receiving gas passing through the diffusor, whereby expansion of said bag-like member causes said missile to be launched from said tube.

2. Apparatus for launching a missile as in claim 1, in which the expandable member is folded onto itself prior to being expanded by gas from the generator.

3. Apparatus for launching a missile as in claim 1, in which the openings are of such a number and dimensions as to produce a gaseous counter thrust to equilibrate the recoil upon missile launch.

4. Apparatus for launching a missile as in claim 1, in which a heat absorbing material is located in the gas generator between the diffusor and the expandable member.

5. Means for launching a missile as in claim 4, in which the heat absorbing member consists of granulated silicon dioxide.

6. Apparatus for launching a missile as in claim 1, in which the expandable member includes an elastic bag having a single opening, said opening adapted to fit onto the gas generator for receiving gas therefrom.

7. Apparatus for launching a missile as in claim 6, in which the elastic bag when expanded is elongate and of such dimensions as to enable sliding receipt within the tube, the combined overall length of the bag and gas generator being substantially the same as the tube length.

8. Apparatus for launching a missile as in claim 6, in which the elastic bag is constructed of nylon fabric and includes a reinforced portion.

9. Apparatus for launching a missile as in claim 8, in which the reinforced portion includes multiple layers of nylon fabric.

10. Apparatus for launching a missile as in claim 6, in which portions of the plastic bag adjacent the opening include a heat insulating material.

11. Apparatus for launching a missile as in claim 10, in which the heat insulating material is a polymeric.

* * * * *

UNITED STATES PATENT AND TRADEMARK OFFICE

CERTIFICATE OF CORRECTION

PATENT NO. : 4,944,210

DATED : July 31, 1990

INVENTOR(S) : Thomas G. Flock Scott D. Baysinger

It is certified that error appears in the above-identified patent and that said Letters Patent is hereby corrected as shown below:

Claim 10, col. 4, line 64 delete "plastic" and insert -- elastic --.

Signed and Sealed this

Thirteenth Day of October, 1992

*Attest:*

DOUGLAS B. COMER

*Attesting Officer*

*Acting Commissioner of Patents and Trademarks*